US008646384B1

(12) United States Patent
Moglia

(10) Patent No.: US 8,646,384 B1
(45) Date of Patent: Feb. 11, 2014

(54) MANUAL COMPACTOR

(71) Applicant: James D. Moglia, Stewart Manor, NY (US)

(72) Inventor: James D. Moglia, Stewart Manor, NY (US)

( * ) Notice: Subject to any disclaimer, the term of this patent is extended or adjusted under 35 U.S.C. 154(b) by 0 days.

(21) Appl. No.: 13/850,718

(22) Filed: Mar. 26, 2013

(51) Int. Cl.
*B30B 15/06* (2006.01)

(52) U.S. Cl.
USPC ..... 100/227; 100/59; 100/98 R; 100/100; 100/229 A; 100/265; 100/295; 220/908

(58) Field of Classification Search
USPC ..... 100/54, 56, 59, 94, 98 R, 100, 226, 227, 100/228, 229 A, 245, 246, 247, 265, 295; 220/578, 263, 908, 908.1, 495.08
See application file for complete search history.

(56) References Cited

U.S. PATENT DOCUMENTS

| | | | | |
|---|---|---|---|---|
| 3,863,563 | A | 2/1975 | Popeil | |
| 4,263,843 | A * | 4/1981 | Hammersmith et al. | 100/37 |
| 4,331,074 | A * | 5/1982 | Behman | 100/215 |
| 4,427,125 | A | 1/1984 | Tuitt | |
| 4,593,615 | A * | 6/1986 | Kehl | 100/227 |
| 4,649,813 | A * | 3/1987 | Kehl | 100/227 |
| 4,991,500 | A | 2/1991 | Knapp | |
| 5,115,736 | A * | 5/1992 | Rodolico et al. | 100/90 |
| 5,179,893 | A * | 1/1993 | Richardson | 100/98 R |
| 6,910,412 | B2 * | 6/2005 | Ko | 100/229 A |
| 8,234,977 | B2 * | 8/2012 | Armstrong | 100/227 |

* cited by examiner

*Primary Examiner* — Jimmy T Nguyen

(57) ABSTRACT

A manual compactor that includes an air ventilation system and also a lid that is capable of being forced downward onto trash within a trash can. The trash can has a wheel base. The air ventilation system includes an internal aerated ring with a series of vent holes, with the ring being attached to a pair of internal air channels that open to the outside air. The lid is capable of either being mounted on top of the trash can or in the alternative, can be shoved downward onto trash within the trash can. A series of serrated blades mounted on the underside of the lid are used to cut up and shred the trash within the compactor while it is being compacted.

11 Claims, 5 Drawing Sheets

MANUAL COMPACTOR

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of manual compactors are known in the prior art. However, what is needed is a manual compactor that provides an easy mechanism allowing an individual to manually push down on garbage located within the compactor, an air vent for quick air pressure equalization between the inside and outside of the compactor, and a number of serrated blades designed to help shred the garbage within the compactor.

FIELD OF THE INVENTION

The present invention relates to a manual compactor, and more particularly, to a manual compactor that provides features and characteristics above and beyond existing manual compactors.

SUMMARY OF THE INVENTION

The general purpose of the present manual compactor, described subsequently in greater detail, is to provide a manual compactor which has many novel features that results in a manual compactor which is not anticipated, rendered obvious, suggested, or even implied by prior art, either alone or in combination thereof.

A manual compactor is disclosed that includes an air ventilation system and also a lid that is capable of being forced downward onto an amount of trash. The manual compactor generally includes a trash can on a wheel base with a lid attached to the trash can. The air ventilation system includes an internal aerated ring with a series of vent holes, with the ring being attached to a pair of internal air channels that open to the outside air. The lid is capable of either being mounted on top of the trash can or in the alternative, can be shoved downward onto an amount of trash. Serrated blades mounted on the underside of the lid are used to cut up and shred the trash disposed within the compactor while it is being compacted.

Thus has been broadly outlined the more important features of the present manual compactor so that the detailed description thereof that follows may be better understood and in order that the present contribution to the art may be better appreciated.

DETAILED DESCRIPTION OF THE DRAWINGS

Figure 1:
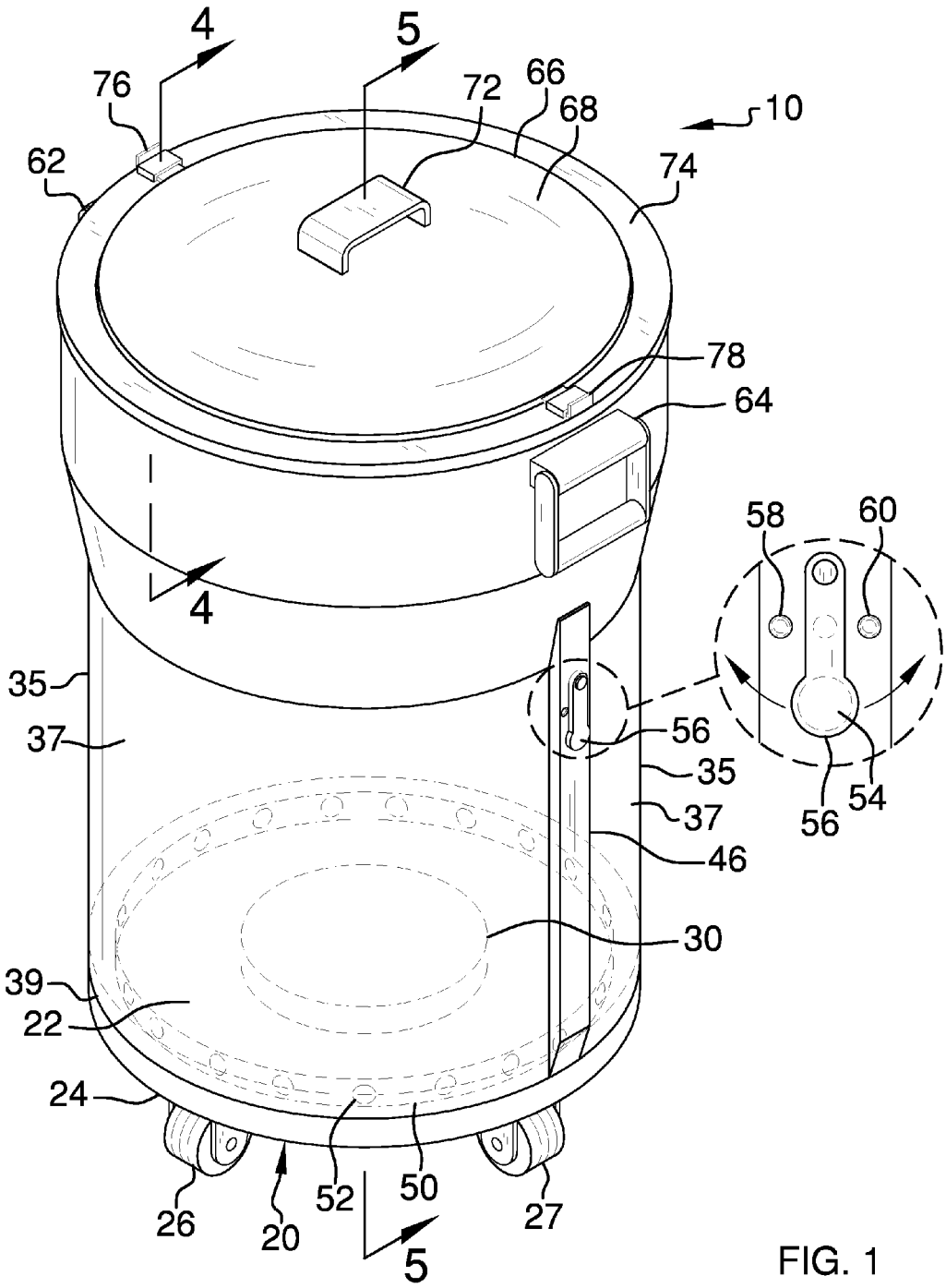
FIG. 1 is a front perspective view of the manual compactor.
Figure 2:
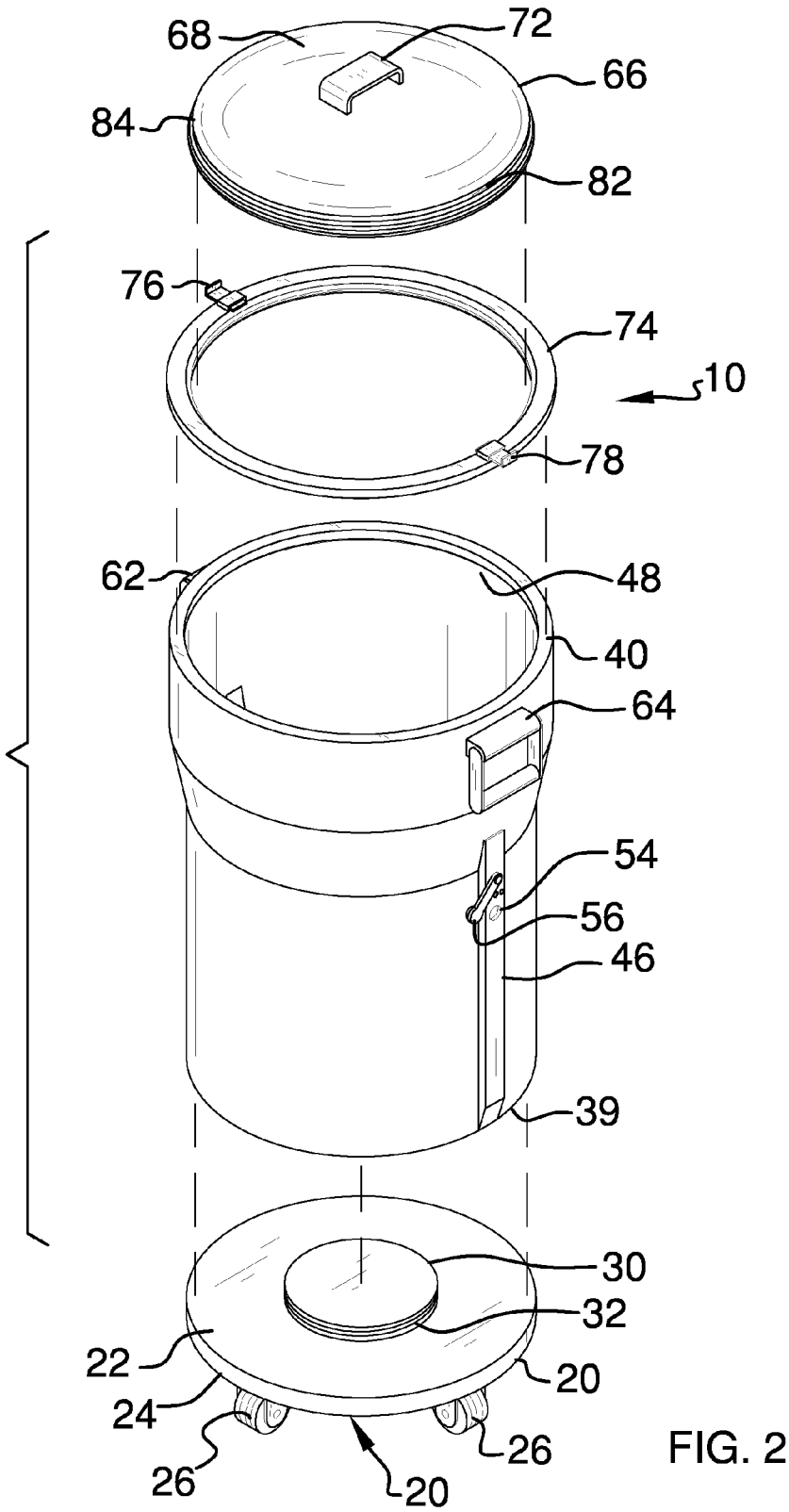
FIG. 2 is a front perspective view of the various components of the manual compactor.
Figure 3:
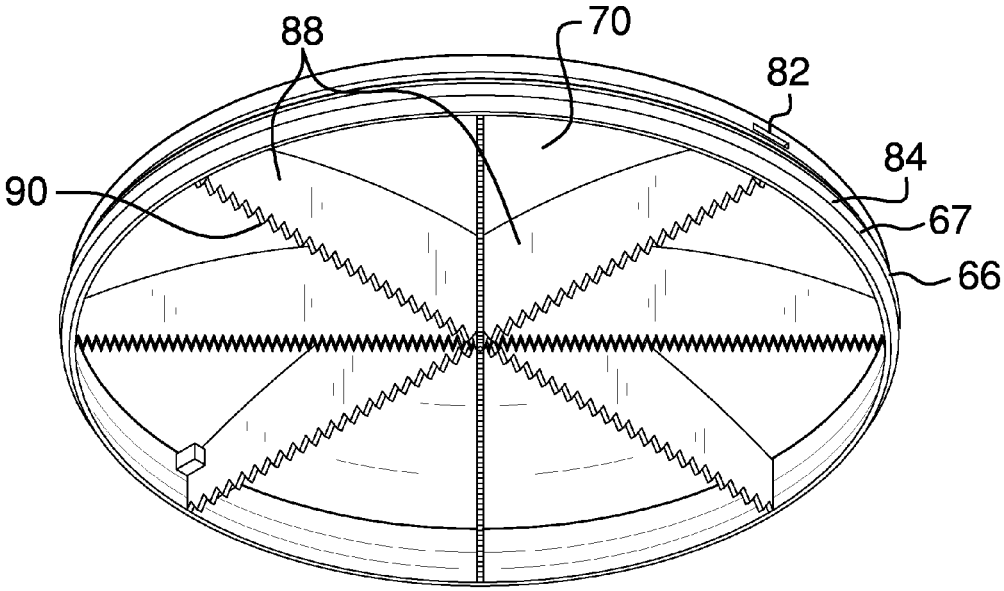
FIG. 3 is a bottom perspective view of the lid of the manual compactor.

With reference now to the drawings, and in particular FIGS. 1 through 6 thereof, an example of the manual compactor employing the principles and concepts of the present manual compactor and generally designated by the reference number 2 will be described.

Referring to FIGS. 1 through 6, a preferred embodiment of the present manual compactor 10 is illustrated. The manual compactor 10 includes a wheel base 20 having an upper surface 22 and a lower surface 24. A trio of wheels 26, 27, 28 are attached to the lower surface 24 of the wheel base 20.

A disk-shaped connector base 30 is attached to the upper surface 22 of the wheel base 20. The connector base 30 has a plurality of external threads 32 disposed thereon.

Trash can 35 is cylindrical in nature and has an outer side surface 37, a bottom surface 39, and an upper perimeter 40. The bottom surface 39 has a cylindrical indentation 41 therein. The indentation 41 has a plurality of internal threads 43 that are threadably engageable to the external threads 32 located on the connector base 30. The trash can 35 also has a pair of air channels 45, 46. Each air channel 45, 46 is located between the outer side surface 37 and an inner side surface 48. The air channels 26 and 27 are diametrically opposed to each other. The air channels 46, 46 are connected to an aerated ring 50 which is attached to the bottom surface 39 and the inner side surface 48 of the trash can 35. The aerated ring 50 has a plurality of spaced-apart holes 52 therein, which allow air to flow freely between the inside of the trash can 35, the aerated ring 50, and the air channels 45, 46.

Each of the air channels 45, 46 has a vent hole 54 therein. Each vent hole 54 is covered by a plug 36 disposed adjacent thereto on the outer side surface 37 of the trash can 35. Each vent hole 54 and its associated plug 56 are located on the outer side surface 37 of the trash can 35. Adjacent to each plug 56 is a pair of indents 58, 60. Each of the indents 58, 60 is located on the outer side surface 37 of the trash can 35, allowing the plug to be temporarily placed against an indent 58, 60 instead of covering the respective vent hole 54.

The trash can 35 also has a pair of side handles 62, 64 located on opposite sides of the outer side surface 37.

Figure 4:
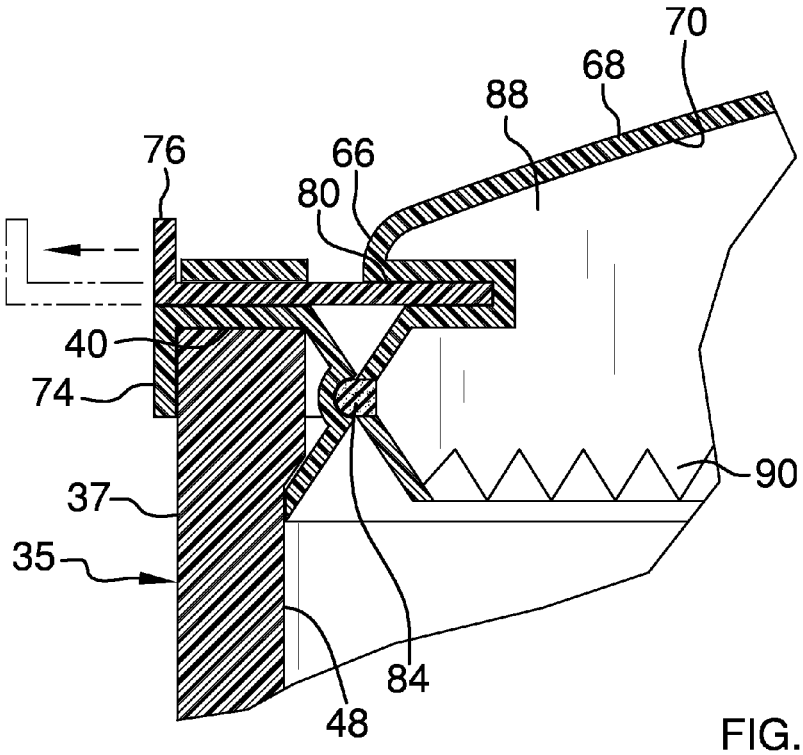
FIG. 4 shows a side cutaway view of the interaction between the side of the trash can of the manual compactor and the lid of the manual compactor.
Figure 5:
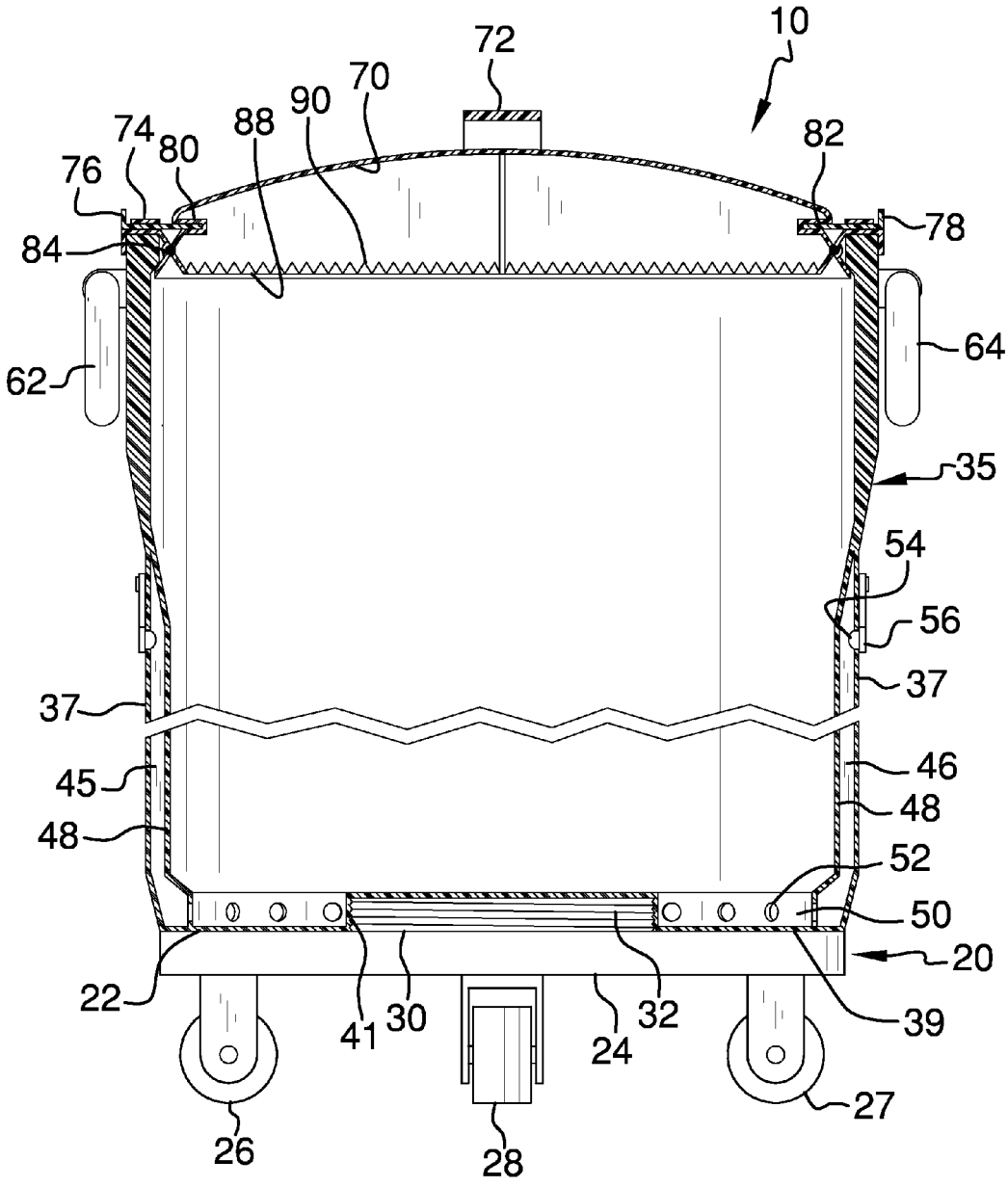
FIG. 5 shows a side cutaway view of the manual compactor.
Figure 6:
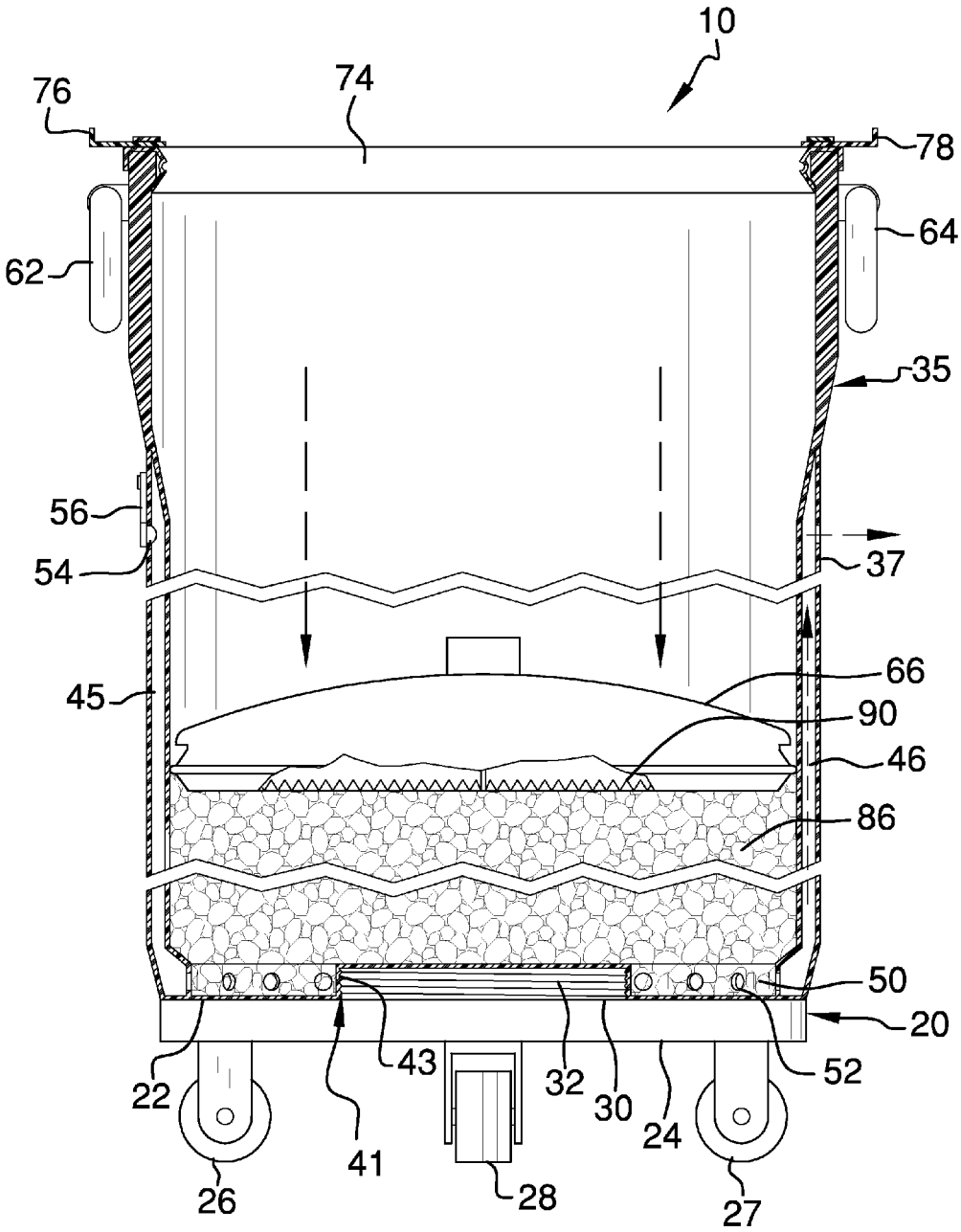
FIG. 6 shows a side cutaway view of the manual compactor as it would appear in use.

The manual compactor 10 also has a lid 66 that covers the trash can 35. The lid 66 has an upper surface 68 and a lower surface 70. A top handle 72 is attached to the upper surface 48 of the lid 66. An outer ring 74 engages the upper perimeter 40 of the trash can 35. A pair of slide locks 76, 78 is disposed on the outer ring 74, preferably on opposite sides thereof from each other. The lid 66 has two slots 80, 82 therein, which are also preferably disposed on opposite side of the lid 66 to align the slots 80, 82 with the slide locks 76, 78. Each slide lock 76, 78 engages the respective slot 80, 82 in a locked position to hold the lid 66 in place atop the trash can 35 and in an alternate unlocked position as shown in FIG. 4. In the locked position and the alternate unlocked position, the lid 66 lockingly engages the outer ring 74 as shown in FIG. 5, and alternately is released from the outer ring 74 as illustrated in FIG. 6, respectively.

Lid 66 also has an outer perimeter 67 and an a rubber seal 84 is continuously disposed along the outer perimeter 67 to temporarily seal the lid and the trash can 35 together when the lid is placed atop the trash can 35.

To remove lid 66 to place trash 86 within the trash can 35 or to alternately push down the lid 66, a user pulls the slide locks 76, 78 in alternate inward and outward directions, respectively. The lower surface 70 of lid 66 has a plurality of serrated blades 88 that each has a plurality of teeth 90. The teeth 90 assist the user in cutting up and shredding trash 86 disposed underneath the lid 66 when the lid 66 is pushed down within the trash can 35 to compact the trash 86 disposed therein.

What is claimed is:

1. A manual compactor comprising:

a wheel base having an upper surface and a lower surface;

a trash can disposed atop the wheel base, the trash can having an outer side surface, a bottom surface, and an upper perimeter;

a pair of side handles attached to the outer side surface of the trash can;

a lid of the trash can, the lid having an upper surface and a lower surface;

a top handle attached to the upper surface of the lid;

an outer ring engaging the upper perimeter of the trash can;

a pair of slide locks disposed on the outer ring on opposite sides thereof;

a pair of slots disposed within the lid on opposite sides thereof;

wherein each slide lock engages the respective slot in a locked position and disengages from the respective slot in an alternate unlocked position;

wherein the lid lockingly engages the outer ring in both of the locked position and the alternate unlocked position; and wherein the lid engages the outer ring when moved to the locked position and alternately disengages the outer ring when in the alternate unlocked position to move downward to compact garbage material in the trash can.

2. The manual compactor according to claim 1 further comprising:

a connector base attached to the upper surface of the wheel base;

a plurality of external threads disposed on the connector base;

a cylindrical indentation disposed within the bottom surface of the trash can;

a plurality of internal threads disposed on the indentation, the internal threads selectively engagable to the external threads of the connector base, wherein upon the engagement of the internal threads and the external threads, the trash can is secured to the wheel base.

3. The manual compactor according to claim 2 further comprising:

an inner side surface of the trash can;

a pair of air channels disposed within the trash can between the outer side surface and the inner side surface, the air channels disposed in a diametrically opposed position;

an aerated ring attached to the bottom surface and the inner side surface of the trash can; and a plurality of spaced-apart holes disposed within the aerated ring, the holes configured to allow air to flow freely between the inside of the trash can, the aerated ring, and each air channel of the pair of air channels.

4. The manual compactor according to claim 3 further comprising:

a vent hole disposed within each air channel on the outer side surface of the trash can; and a plug attached to the outer side surface adjacent to each vent hole, wherein each plug is configured to plug the adjacent vent hole.

5. The manual compactor according to claim 4 further comprising a pair of indents located adjacent to each plug;

wherein each indent is configured to secure a respective plug when the plug is not covering up the adjacent vent hole.

6. The manual compactor according to claim 5 further comprising:

a plurality of serrated blades attached to the lower surface of the lid;

a plurality of teeth disposed on each serrated blade; and wherein the plurality of teeth is configured to cut up and shred trash disposed within the trash can.

7. The manual compactor according to claim 6 further comprising a plurality of wheels attached to the lower surface of the wheel base.

8. The manual compactor according to claim 7 wherein the plurality of wheels comprises a trio of wheels.

9. The manual compactor according to claim 6 further comprising:

an outer perimeter of the lid; and a rubber seal continuously disposed along the outer perimeter.

10. The manual compactor according to claim 7 further comprising:

an outer perimeter of the lid; and a rubber seal continuously disposed along the outer perimeter.

11. A manual compactor comprising:

a wheel base having an upper surface and a lower surface;

a trash can disposed atop the wheel base, the trash can having an outer side surface, a bottom surface, and an upper perimeter;

a pair of side handles attached to the outer side surface of the trash can;

a lid of the trash can, the lid having an upper surface and a lower surface, a top handle attached to the upper surface of the lid;

an outer ring engaging the upper perimeter of the trash can;

a pair of slide locks disposed on the outer ring on opposite sides thereof;

a pair of slots disposed within the lid on opposite sides thereof;

wherein each slide lock engages the respective slot in a locked position and disengages from the respective slot in an alternate unlocked position;

wherein the lid lockingly engages the outer ring in both of the locked position and the alternate unlocked position;

wherein the lid engages the outer ring when moved to the locked position and alternately disengages the outer ring when in the alternate unlocked position to move downward to compact garbage material in the trash can;

a connector base attached to the upper surface of the wheel base;

a plurality of external threads disposed on the connector base;

a cylindrical indentation disposed within the bottom surface of the trash can;

a plurality of internal threads disposed on the indentation, the internal threads selectively engagable to the external threads of the connector base, wherein upon the engagement of the internal threads and the external threads, the trash can is secured to the wheel base;

an inner side surface of the trash can;

a pair of air channels disposed within the trash can between the outer side surface and the inner side surface, the air channels disposed in a diametrically opposed position;

an aerated ring attached to the bottom surface and the inner side surface of the trash can;

a plurality of spaced-apart holes disposed within the aerated ring, the holes configured to allow air to flow freely between the inside of the trash can, the aerated ring, and each air channel of the pair of air channels;

a vent hole disposed within each air channel on the outer side surface of the trash can;

a plug attached to the outer side surface adjacent to each vent hole, wherein each plug is configured to plug the adjacent vent hole;

a pair of indents located adjacent to each plug;

wherein each indent is configured to secure a respective plug when the plug is not covering up the adjacent vent hole;

a plurality of serrated blades attached to the lower surface of the lid;

a plurality of teeth disposed on each serrated blade;

wherein the plurality of teeth is configured to cut up and shred trash disposed within the trash can;

a plurality of wheels attached to the lower surface of the wheel base;

an outer perimeter of the lid; and a rubber seal continuously disposed along the outer perimeter.

* * * * *